US008905905B2

(12) United States Patent
Mangalindan

(10) Patent No.: US 8,905,905 B2
(45) Date of Patent: Dec. 9, 2014

(54) PUSHUP EXERCISER HAVING MULTIPLE HAND POSITIONING

(76) Inventor: Leonard Mangalindan, Tustin, CA (US)

( * ) Notice: Subject to any disclaimer, the term of this patent is extended or adjusted under 35 U.S.C. 154(b) by 453 days.

(21) Appl. No.: 13/134,639

(22) Filed: Jun. 13, 2011

(65) Prior Publication Data

US 2012/0316043 A1 Dec. 13, 2012

(51) Int. Cl.

| | |
|---|---|
| ***A63B 71/00*** | (2006.01) |
| ***A63B 26/00*** | (2006.01) |
| ***A63B 23/12*** | (2006.01) |
| *A63B 71/06* | (2006.01) |

(52) U.S. Cl.

CPC ..... *A63B 23/1236* (2013.01); *A63B 2071/0694* (2013.01); *A63B 2210/50* (2013.01)

USPC ..... 482/141; 482/142

(58) Field of Classification Search

USPC ..... 482/17, 23, 24, 171, 141, 142, 37

See application file for complete search history.

(56) References Cited

U.S. PATENT DOCUMENTS

| | | | | |
|---|---|---|---|---|
| 4,358,106 | A * | 11/1982 | Shadford | 482/141 |
| 5,226,868 | A * | 7/1993 | Montgomery | 482/141 |
| 6,129,651 | A * | 10/2000 | Denaro | 482/141 |
| 7,645,218 | B2 * | 1/2010 | Potok | 482/141 |

OTHER PUBLICATIONS

The Strength Builder "The Ultimate Press-Up Workout System", Dec. 30, 2007, www.thestrengthbuilder.com, can be found at http://web.archive.org/web/20070218121848/http://www.thestrengthbuilder.com/.*

Strength Builder www.thestrengthbuilder.com.

Perfect Pushup by Perfect Fitness www.perfectonline.com.

Net2Fitness www.net2fitness.com.

* cited by examiner

*Primary Examiner* — Loan H Thanh
*Assistant Examiner* — Megan Anderson
(74) *Attorney, Agent, or Firm* — Roy A. Ekstrand

(57) ABSTRACT

A pushup exerciser includes a supporting board formed of a pair of joined board sections each defining an upper surface having a plurality of post receptacles formed therein. The post receptacles are arranged in pairs with each pair suitably spaced for receiving attachment posts of a handle unit. Each post receptacle pair includes a color indicia. The color indicia are selectively colored to provide association between handle unit positions in accordance with a selected theme such as muscle group emphasis. A pair of handle units suitable for gripping during pushup exercise are locatable and attachable to the board surface at positions and angular orientations defined by the post receptacle pairs.

8 Claims, 14 Drawing Sheets

PUSHUP EXERCISER HAVING MULTIPLE HAND POSITIONING

FIELD OF THE INVENTION

This invention relates generally to fitness and exercise apparatus and particularly to fitness and exercise apparatus used to perform pushup exercises.

BACKGROUND OF THE INVENTION

Perhaps one of the most well-known and frequently employed types of exercises is that generally referred to a "pushup". While pushups may be performed in a variety of routines, the most basic pushup exercise is performed by the participant laying face down upon a floor surface with the upper feet and toes supporting the lower portion of the body and with arms extended outwardly and downwardly placing hands approximately beneath the participant's shoulders. Frequently, the participant supports the participant's hands upon the floor surface using extended fingers and thumb to actually touch the floor surface. In this position, the participant then stiffens and maintains a rigid straight line body position while pushing the body upwardly using the participant's arms until the arms are fully extended and the participant's body is supported upon the foot and toes together with the participants hands. Thereafter, the participants simply lowers and raises the body using the participant's arms. In many instances, the objective of a "perfect" pushup is attained by lightly touching the chest to the floor between the participant's hands during each downward movement.

Among the many variations of pushup exercises utilized, one is well-known for accommodating persons having limited upper body and arm strength in which the lower body is supported upon the participant's knees rather that foot and toes. When so supported, the pushup requires substantially less upper body and arm strength for exercise. At the opposite extreme, persons seeking to increase the effort required for the pushup exercise often utilize a single supporting hand and perform the so-called one handed pushup. By way of further variation, participants often utilize different hand positions such as wider or narrower spacing to add variety to the pushup exercises. Additionally, participants may choose to rotate the hand positions upon the floor for further variation of the exercise.

Recognizing the long term popularity and effectiveness of pushups as a fitness and conditioning exercise, practitioners in the art have endeavored to provide a variety of apparatus which is utilized in performing exercises. One such example is an apparatus produced and marketed under the product name "the strength builder" which utilizes an elongated flat board having a plurality of closed end holes formed therein. A pair of cooperating handles is provided each of which includes an inverted U-shaped handle grip supported upon a small generally flat platform base. The platform base further includes a downwardly extending generally cylindrical post at one end of the platform. The posts on the handles are sized and shaped to be received within the closed end apertures one elongated board. The board further includes a plurality of indicia lines together with numerals to identify hand locations and angular positions upon the board for each of the handles. In its intended use, the user places the posts of each of the handles into the selected closed end apertures on the board and rotates the handles to the desired angular position upon the board. Thereafter, the user grips the upper portion of the inverted U-shape handle grips and performs pushup exercises thereon.

Another variation of pushup exercise product provided by practitioners in the art is sold under the product name "perfect pushup mobile unit" sold by Perfect Fitness. The perfect pushup mobile unit apparatus includes a pair of generally disk shaped circular platforms each having an inverted U-shape handle pivotally secured to the edges thereof. The handles are pivotable between a vertical position intended for use and a flat position intended for storage and transport. In the anticipated use of the perfect pushup mobile unit product the participant grips each inverted U-shaped handle and positions the circular bases thereof upon the floor and thereafter assumes the typical pushup position. The user is able to pivot the hand grip units to set a particular rotational position of the participant's hands during the pushup exercise. Thereafter, the pushup exercise is carried forward in the conventional fashion. By way of further variety, a plurality of similar products are sold which are generally described in the art as "pushup stands" which are characterized by pairs of hand units each including a hand grip portion. In the most typical stand configuration, the hand grip portion includes an inverted U-shaped member having downwardly extending legs each of which is joined to a short transverse floor piece in a right angle attachment. Variations of this pushup stand apparatus are provided by fabricating variously formed tubular material shapes all of which are employed in a similar manner to perform pushup exercises.

While the foregoing described prior art devices have to some extent improved the art and have in some instances enjoyed commercial success, there remains nonetheless a continuing need in the art for ever more improved pushup exerciser apparatus.

SUMMARY OF THE INVENTION

Accordingly, it is a general object of the present invention to provide an improved exercise apparatus suitable for pushup exercise activities. It is a more particular object of the present invention to provide an improved apparatus for pushup exercise which facilitates and orderly and organized sequence of hand positions during pushup exercises. It is a still more particular object of the present invention to provide an improved apparatus for pushup exercise which maintains the handles of the pushup apparatus in a secure non-pivoting reliable and repeatable position.

In accordance with the present invention, there is provided apparatus for performing pushup exercises, the apparatus comprising: a generally planar board defining a generally planar top surface; a plurality of post receptacles formed in the top surface; a pair of handle units each having attachment means for engaging selected ones of the post receptacles in a fixed location and angular orientation upon the top surface; and a plurality of color indicia formed on the top surface in association with selected ones of the post receptacles, the color indicia defining groups of color indicia each group being distinguishable from other groups by a characteristic color whereby the post receptacles and the color indicia groups cooperate to define selected positions of the handle units upon the board.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
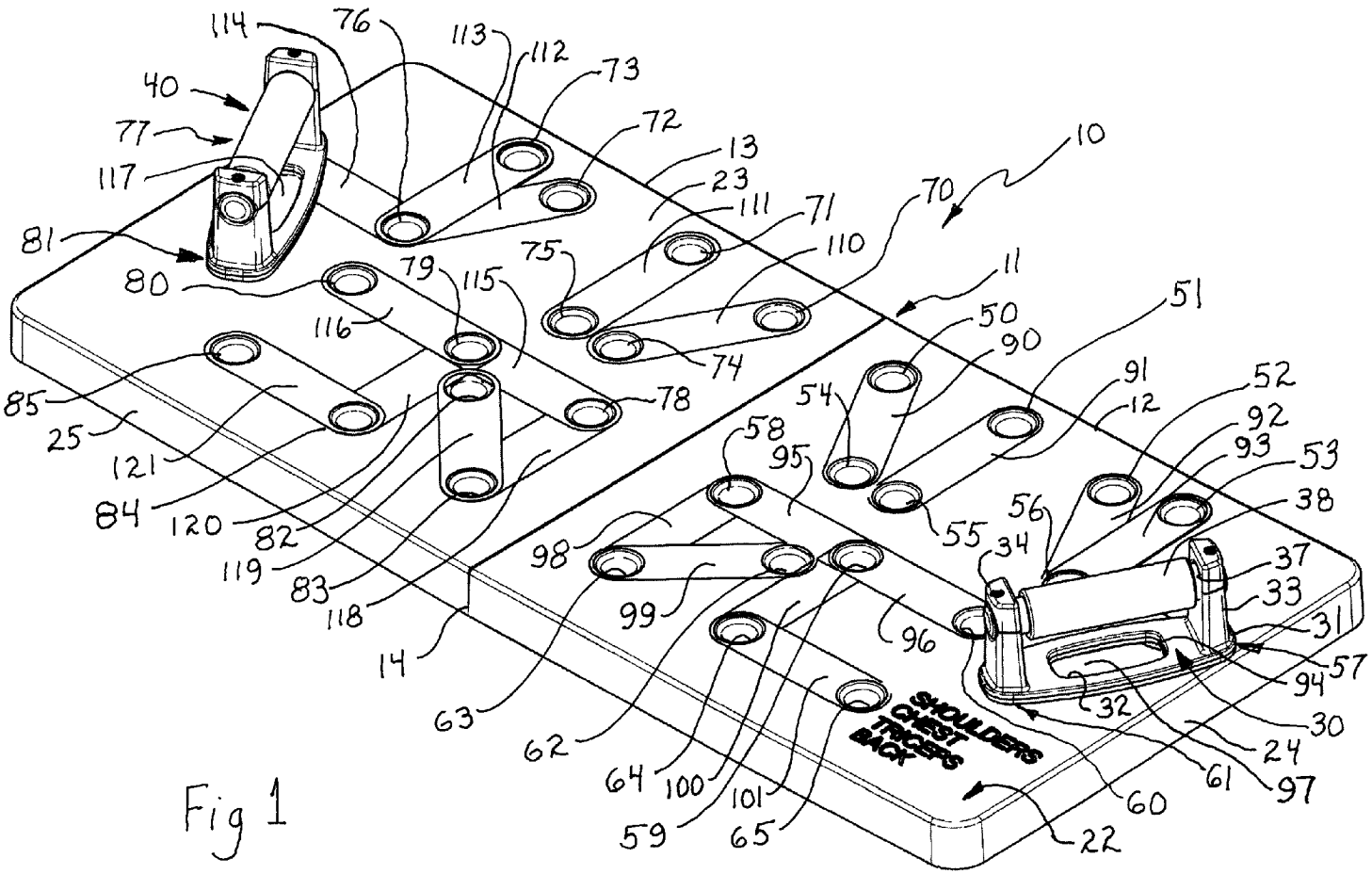
FIG. 1 sets forth a perspective view of a pushup exerciser constructed in accordance with the present invention.

FIG. 1 sets forth a perspective view of a pushup exerciser constructed in accordance with the present invention and generally referenced by numeral 10. Pushup exerciser 10 includes a board 11 formed by a pair of board sections 12 and 13 joined along a board section junction 14. In combination, board sections 12 and 13 form a generally planar elongated board 11 which, in accordance with the present invention, receives a pair of handle units 30 and 40 at selected positions upon board 11 to facilitate the multiple hand position pushup exercise activity. It will be apparent to those skilled in the art from the descriptions which follow that the present invention pushup exerciser facilitates a substantial variety of hand positions and angles each of which is maintained in a secure attachment of handle units 30 and 40 once a position set has been selected.

More specifically, pushup exerciser 10 is formed of a pair of generally planar board sections 12 and 13 joined along a board section junction 14 in the manner described below in FIGS. 5 and 6. Suffice it to note here that board section junction 14 provides a fixed attachment which allows board sections 12 and 13 to perform as a single extended generally rigid board 11. Board section 12 defines a generally planar top surface 22 which in turn defines a plurality of post receptacles 50 through 65 therein. Similarly, board section 13 includes a generally planar top surface 23 which in turn defines a plurality of post receptacles 70 through 85. It will be noted that post receptacles 70 through 85 are arranged in a pattern which forms a mirror image of the pattern by which post receptacles 50 through 65 are formed in surface 22 of board section 12. Each of post receptacles 50 through 65 formed on board section 12 and post receptacles 70 through 85 formed on board section 13 comprise generally cylindrical closed end receptacles configured and sized to receive the cooperating cylindrical posts formed on the undersides of handle units 30 and 40 (seen below in FIGS. 10 and 11). Thus, post receptacles 50 through 65 of board section 12 are arranged in a pattern which facilitates multiple positioning attachments of handle unit 30 upon top surface 22. Correspondingly, post receptacles 70 through 85 of board section 13 are arranged in a mirror image pattern which facilitates multiple positions for attachment of handle unit 40 upon top surface 23 of board section 13.

In accordance with an important aspect of the present invention, post receptacles 50 through 65 of board section 12 and 70 through 85 of board section 13 are generally arranged in pairs with each pair defining a selected handle unit position upon board 11. In further accordance with an important aspect of the present invention, each pair of post receptacles which define a selectable handle unit position are joined by a color indicia. Each color indicia extends between the pair of post receptacles and which defines a color selected in accordance with a predetermined position code. Accordingly, top surface 22 includes a color indicia 90 extending between post receptacles 50 and 54. Similarly, a color indicia 91 extends between post receptacles 51 and 55 while color indicia 92 extends between post receptacles 52 and 56. A color indicia 93 extends between post receptacles 53 and 56. A color indicia 94 extends between post receptacles 56 and 57 while a color indicia 97 extends between post receptacles 57 and 61 (partially obscured by handle unit 30). Continuing, a color indicia 95 extends between post receptacles 58 and 59 while a color indicia 96 extends between post receptacles 59 and 60. A color indicia 98 extends between post receptacles 58 and 63 while a color indicia 99 extends between post receptacles 62 and 63. A color indicia 100 extends between post receptacles 59 and 64 while a color indicia 101 extends between post receptacles 64 and 65.

In a corresponding fashion, a color indicia 110 extends between post receptacles 70 and 74 of board section 13 while a color indicia 111 extends between post receptacles 71 and 75. Similarly, a color indicia 112 extends between post receptacles 72 and 76 while a color indicia 113 extends between post receptacles 73 and 76 and a color indicia 114 extends between post receptacles 76 and 77 (obscured by handle 40). A color indicia 117 extends between post receptacles 77 and 81 (partially obscured by handle unit 40). A color indicia 115 extends between post receptacles 78 and 79 while a color indicia 116 extends between post receptacles 79 and 80. Finally, a color indicia 118 extends between post receptacles 78 and 83 while a color indicia 119 extends between post receptacles 82 and 83 and a color indicia 120 extends between post receptacles 79 and 84 and a color indicia 121 extends between post receptacles 84 and 85.

Board section 12 further includes a downwardly extending sidewall 24 while board section 13 further includes a downwardly extending sidewall 25. Sidewalls 24 and 25 extend about the entire periphery of board sections 12 and 13 respectively and are joined along board section junction 14 to form a rigid self-supporting member for board 11. In the preferred fabrication of the present invention, sidewalls 24 and 25 are sufficient to provide depth for post receptacles 50 through 65 and 70 through 85. The fabrication of sidewalls 24 and 25 and their relationship to post receptacles 50 through 65 and 70 through 85 is set forth below in FIG. 9 in greater detail. However, suffice it to note here that sidewalls 24 and 25 support top surfaces 22 and 23 respectively above the surface upon which board 11 is rested to maintain clearance between post receptacles 50 through 65 and 70 through 85 above the supporting floor or surface upon which board 11 is rested. In the preferred fabrication of the present invention, board sections 12 and 13 are fabricated as integrally formed molded plastic units which, when joined along board section junction 14 in the manner shown in FIGS. 5 and 6 and described below, form board 11 into an elongated rigid single exercise board. The fabrication of board 11 in separatable board sections 12 and 13 set forth below in FIGS. 5 through 8 facilitate convenient separations of board sections 12 and 13 for easy storage and transport.

Figure 2:
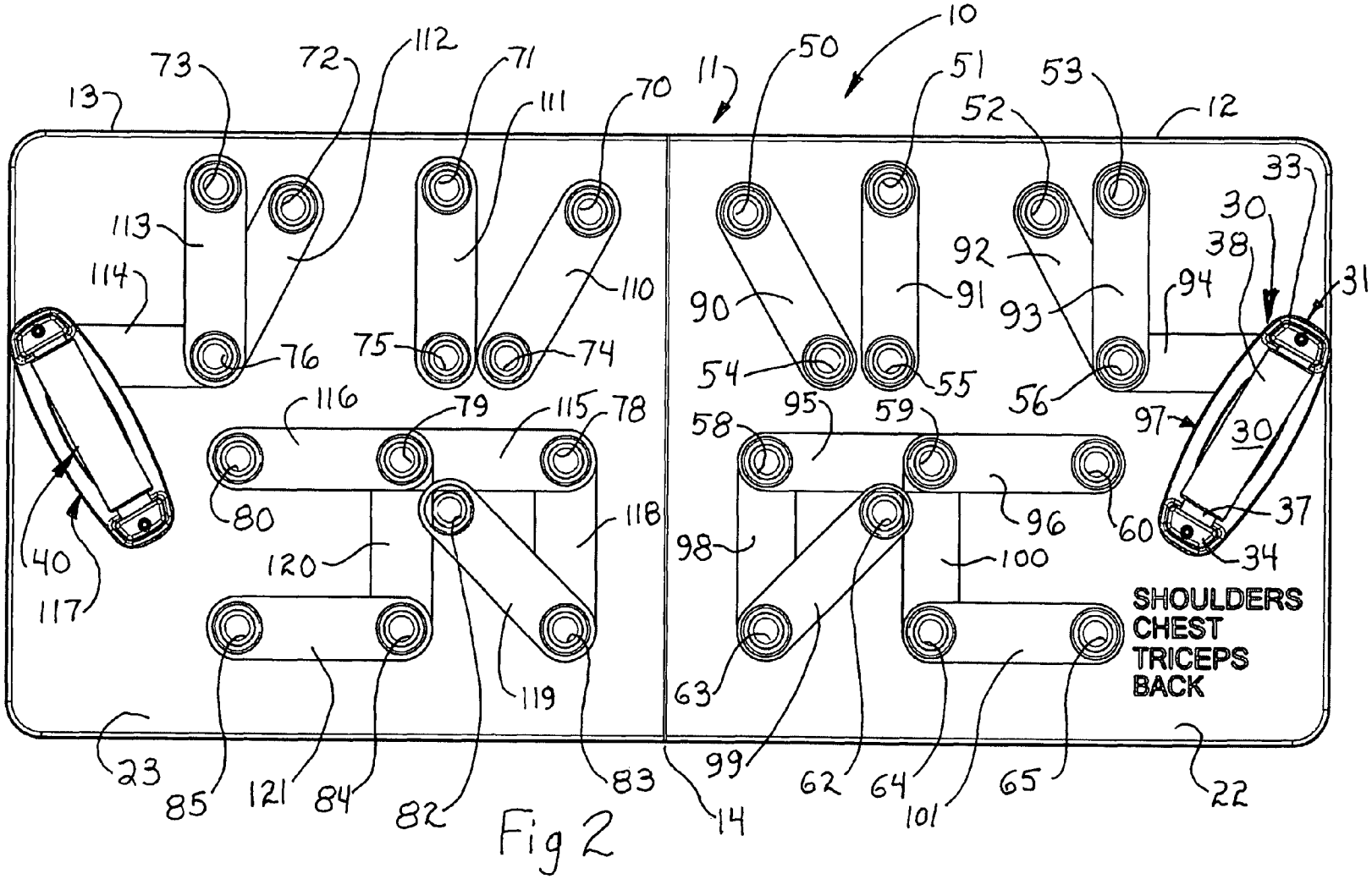
FIG. 2 sets forth a top plan view of the present invention pushup exerciser.

FIG. 2 sets forth a top plan view of pushup exerciser 10 showing board sections 12 and 13 joined along board section junction 14 to form a rigid board 11. FIG. 2 also shows handle units 30 and 40 positioned upon board sections 12 and 13 respectively. Thus, FIG. 2 shows a top plan view of board 11 and handle units 30 and 40 in an exemplary configuration for the execution of the pushup exercise.

More specifically, pushup exerciser 10 is formed of a pair of generally planar board sections 12 and 13 joined along a board section junction 14 in the manner described below in FIGS. 5 and 6. Suffice it to note here that board section junction 14 provides a fixed attachment which allows board sections 12 and 13 to perform as a single extended generally rigid board 11. Board section 12 defines a generally planar top surface 22 which in turn defines a plurality of post receptacles 50 through 65 therein. Similarly, board section 13 includes a generally planar top surface 23 which in turn defines a plurality of post receptacles 70 through 85. It will be noted that post receptacles 70 through 85 are arranged in a pattern which forms a mirror image of the pattern by which post receptacles 50 through 65 are formed in surface 22 of board section 12. Each of post receptacles 50 through 65 formed on board section 12 and post receptacles 70 through 85 formed on board section 13 comprise generally cylindrical closed end receptacles configured and sized to receive the cooperating cylindrical posts formed on the undersides of handle units 30 and 40 (seen below in FIGS. 10 and 11). Thus, post receptacles 50 through 65 of board section 12 are arranged in a pattern which facilitates multiple positioning attachments of handle unit 30 upon top surface 22. Correspondingly, post receptacles 70 through 85 of board section 13 are arranged in a mirror image pattern which facilitates multiple positions for attachment of handle unit 40 upon top surface 23 of board section 13.

In accordance with an important aspect of the present invention, post receptacles 50 through 65 of board section 12 and 70 through 85 of board section 13 are generally arranged in pairs with each pair defining a selected handle unit position upon board 11. In further accordance with an important aspect of the present invention, each pair of post receptacles which define a selectable handle unit position are joined by a color indicia. Each color indicia extends between the pair of post receptacles and defines a color selected in accordance with a predetermined position code. Accordingly, top surface 22 includes a color indicia 90 extending between post receptacles 50 and 54. Similarly, a color indicia 91 extends between post receptacles 51 and 55 while color indicia 92 extends between post receptacles 52 and 56. A color indicia 93 extends between post receptacles 53 and 56. A color indicia 94 extends between post receptacles 56 and 57 while a color indicia 97 extends between post receptacles 57 and 61 (partially obscured by handle unit 30). Continuing, a color indicia 95 extends between post receptacles 58 and 59 while a color indicia 96 extends between post receptacles 59 and 60. A color indicia 98 extends between post receptacles 58 and 63 while a color indicia 99 extends between post receptacles 62 and 63. A color indicia 100 extends between post receptacles 59 and 64 while a color indicia 101 extends between post receptacles 64 and 65.

In a corresponding fashion, a color indicia 110 extends between post receptacles 70 and 74 of board section 13 while a color indicia 111 extends between post receptacles 71 and 75. Similarly, a color indicia 112 extends between post receptacles 72 and 76 while a color indicia 113 extends between post receptacles 73 and 76 and a color indicia 114 extends between post receptacles 76 and 77 (obscured by handle 40). A color indicia 117 extends between post receptacles 77 and 81 (partially obscured by handle unit 40). A color indicia 115 extends between post receptacles 78 and 79 while a color indicia 116 extends between post receptacles 79 and 80. Finally, a color indicia 118 extends between post receptacles 78 and 83 while a color indicia 119 extends between post receptacles 82 and 83 and a color indicia 120 extends between post receptacles 79 and 84 and a color indicia 121 extends between post receptacles 84 and 85.

As mentioned above, post receptacles 50 through 65 and 70 through 85 are organized and arranged in post receptacle pairs configured to receive handle units 30 and 40 upon top surfaces 22 and 23 respectively at a variety of selectable positions. Each of the handle unit positions is selected to provide a particular set of benefits for the pushup exercised being performed. For example, the positions of handle unit 30 upon board section 12 identified by color indicia 90, 91, 92 and 93 together with the mirror image positions of handle unit 40 upon board section 13 identified by color indicia 110, 111, 112 and 113 emphasized shoulder muscle development. In accordance with an important aspect of the present invention, color indicia 90, 91, 92 and 93 as well as color indicia 110, 111, 112 and 113 define a common color (in this case red). This common color provides easily understood and observed association of the shoulder muscle emphasizing handle unit positions.

In further accordance with the invention, it will be noted that handle units 30 and 40 are fixed as to location and angular position by the pair of post on each handle unit (seen in FIGS. 10 and 11) and the post receptacle pair receiving them. Thus, the location and angular position of the handle units are securely established and maintained at the selected handle unit positions.

In a similar manner, the handle unit positions of handle unit 30 upon board section 12 identified by color indicia 94, 95 and 97 as well as the handle unit positions of handle unit 40 upon board section 13 identified by color indicia 114, 115 and 117 emphasize chest muscle development. In accordance with the above-mentioned aspect of the present invention, color indicia 94, 95 and 97 as well as color indicia 114, 115 and 117 define a common color (in this case blue). Once again this common color provide easily understood and observed association of the chest muscle emphasis handle unit positions.

In further similarity, the handle positions of handle unit 30 upon board section 12 identified by color indicia 96, 98 and 100 and the positions of handle unit 40 upon board section 13 identified by color indicia 116, 118 and 120 emphasis triceps muscle development. Once again, in accordance with the present invention, color indicia 96, 98 and 100 as well as color indicia 116, 118 and 120 define a common color (in this case green). Once again, this common color provides easily observed and understood association of the triceps muscle emphasis handle unit positions.

Finally, the positions of handle unit 30 upon board section 12 identified by color indicia 99 and 101 and the positions of handle unit 40 upon board section 13 identified by color indicia 119 and 121 emphasize back muscle development. In continued accordance with the present invention color indicia 99, 101, 119 and 121 define a common color (in this case yellow). Once again, this common color provides easily understood and observed association of the back muscle emphasis handle unit positions of the present invention pushup exerciser.

Thus, in accordance with the present invention, handle units 30 and 40 are quickly and easily positionable upon board sections 12 and 13 at a selected position and are maintained in a fixed secure location and angular position by the dual post, dual post receptacle cooperation between handle units 30 and 40 the receptacle pairs upon board sections 12 and 13. The color association provided by the color indicia quickly identifies handle unit locations which facilitate or emphasize a chosen muscle group development without resort to any additional materials or directions. It will be apparent to those skilled in the art that while the examples set forth herein utilizes the color red for shoulder emphasis, blue for chest emphasis, green for tricept emphasis and yellow for back muscle emphasis, other colors may be utilized without departing from the spirit and scope of the present invention. The important aspect with respect to this important facet of the present invention is the provision of color coded muscle group indicia having common colors upon board 11 together with the secure location and angular positioning provided by the dual post configuration of the handle units and post receptacle pairs.

Figure 3:
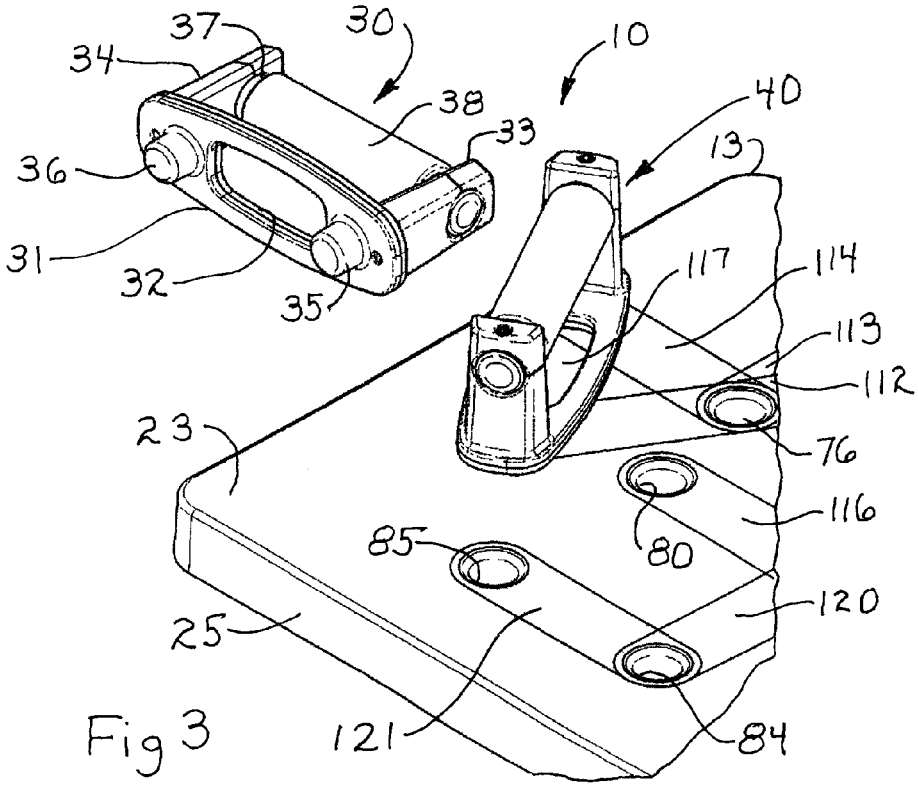
FIG. 3 sets forth an enlarged partial perspective view of a portion of the present invention pushup exerciser.

FIG. 3 sets forth an enlarged partial perspective view of pushup exerciser 10 showing handle units 30 and 40. As described above, pushup exerciser 10 includes a board 11 having a board section 13 within which a plurality of post receptacle pairs are formed. As is also described above, board section 13 defines a generally planar top surface 23 having a plurality of color indicia formed between selected pairs of post receptacles. In FIG. 3, board section 13 shows post receptacles 76, 79, 80, 82, 83, 84 and 85. Board section 13 also defines post receptacles 77 and 81 which are obscured by handle unit 40. Color indicia 112, 113, 114, 116, 117, 120 and 121 are also formed upon surface 23 of board section 13.

FIG. 3 also shows a perspective underside view of handle unit 30. It will be understood by those skilled in the art that handle unit 30 and 40 are identical and that the descriptions of handle unit 30 will apply equally well to handle unit 40. Accordingly, handle unit 30 includes an elongated base 31 defining a rectangular aperture 32 and supporting a pair of generally cylindrical downwardly extending posts 35 and 36. Handle unit 30 further includes a pair of upwardly extending supports 33 and 34 positioned at opposed ends of base 31. A generally cylindrical grip bar 37 extends between grip supports 33 and 34 and is secured in the manner set forth below in FIG. 12. Grip bar 37 further supports a handle grip 38 preferably formed of a resilient soft material such as foam rubber, foam plastic or the like.

With handle unit 40 positioned as shown in FIG. 3, it will be noted that a portion of color indicia 117 upon which handle unit 40 is attached is visible through the aperture formed in the base of the handle unit. This provides assistance in positioning handle units 30 and 40 at the desired location and within the desired color indicia group during exercise activities.

Figure 4:
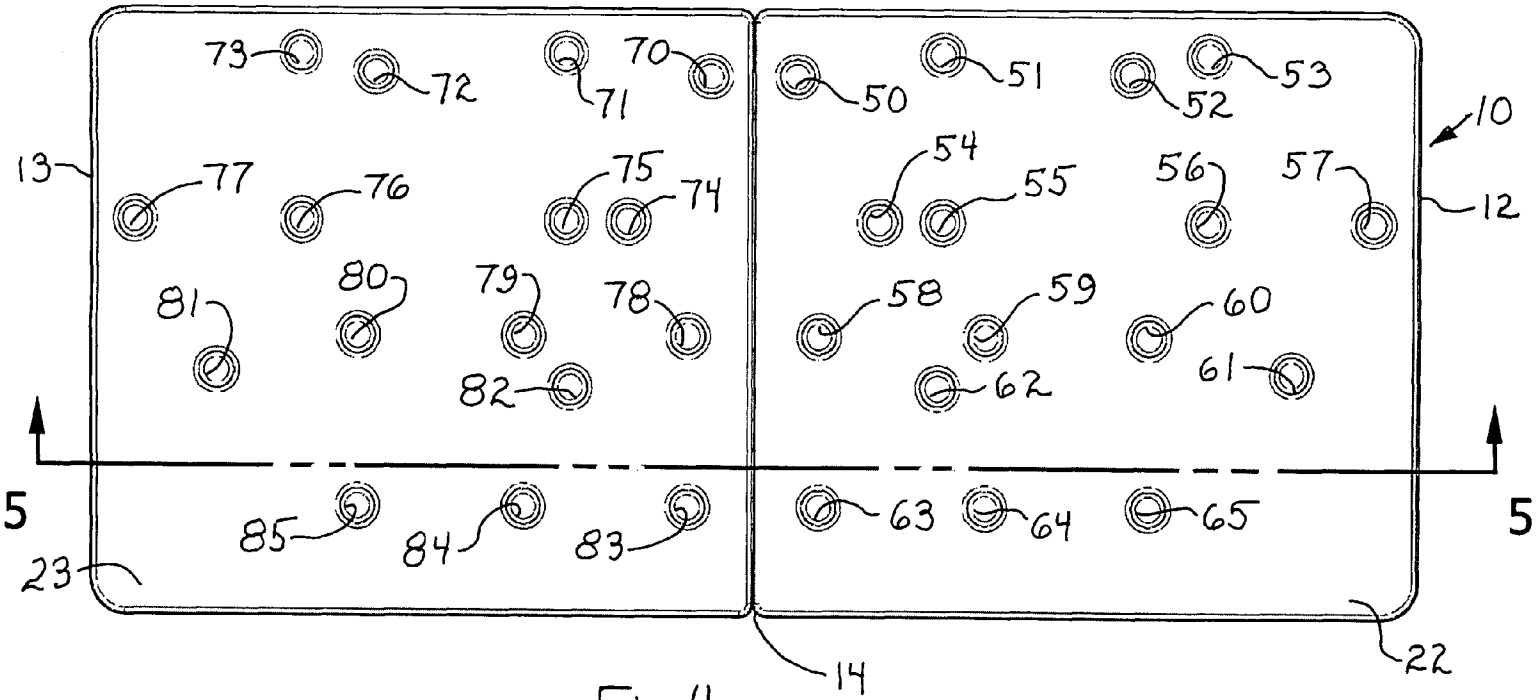
FIG. 4 sets forth a top plan view of the board portion of the present invention pushup exerciser.

FIG. 4 sets forth a top plan view of board 11 which, as mentioned above, comprises board sections 12 and 13 joined along a board section junction 14. As is also mentioned above, board section 12 defines a top surface 22 having a plurality of post receptacles 50 through 65 formed therein. As is also described above, board section 13 defines a top surface 23 having a plurality of post receptacles 70 through 85 formed therein. For purposes of illustration, FIG. 4 omits the above-described color indicia which associate the respective pairs of post receptacles in the above-described manner. Of importance to note in FIG. 4 is the increased difficulty which would arise in identifying the pairs of post receptacles upon board 11 without the aid of color indicia 90 through 101 and 110 through 121 shown above in FIGS. 1 and 2. This emphasizes the great advantage to be provided by the present invention color indicia pairing of post receptacles which is provided in the manner set forth above. In the preferred fabrication of the present invention, board 11 is formed of board sections 12 and 13 to provide an elongated board which may be readily separated to facilitate stacking board sections 12 and 13 one upon the other for a more compact storage and transport. In their preferred fabrication, board sections 12 and 13 are formed of molded plastic or other suitable material which provides the advantageous of low-cost mass-production.

Figure 5:
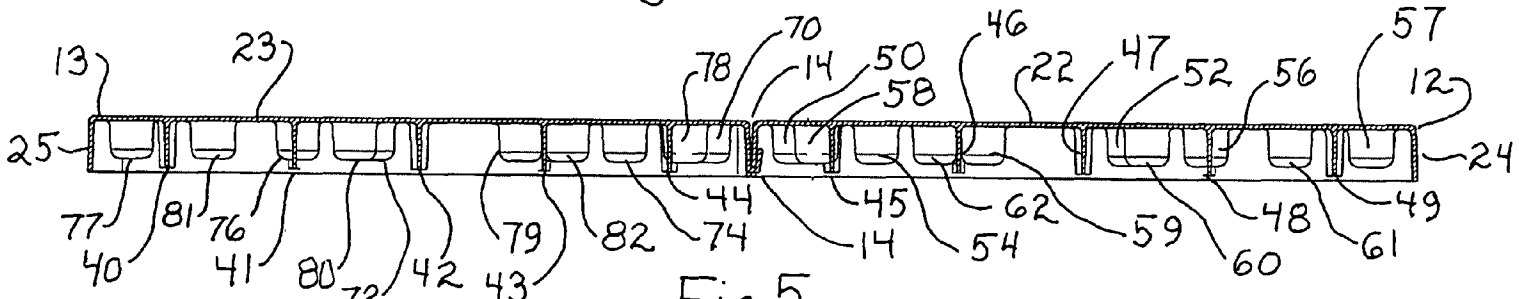
FIG. 5 sets forth a section view of the board portion of the present invention pushup exerciser taken along section lines 5-5 in FIG. 4.

FIG. 5 sets forth a section view of board 11 taken along section lines 5-5 in FIG. 4. As described above, board 11 is formed of board sections 12 and 13 defining respective top surfaces 22 and 23 as well as respective sidewalls 24 and 25. As is also mentioned above, board sections 12 and 13 are joined along board section junction 14. Of importance to note in FIG. 5, is the extension of sidewalls 24 and 25 downwardly from top surfaces 22 and 23 respectively. Thus, in the preferred fabrication of board 11, sidewalls 24 and 25 are longer than the downward extensions of post receptacles formed in top surfaces 22 and 23. To further strengthen board 11 and provide greater support for handle units 30 and 40 during pushup exercise, board 11 defines a plurality of intermediate supporting ribs 40 through 49 spaced beneath board sections 12 and 13. It will be noted that intermediate supporting walls 40 through 49 extend downwardly from top surfaces 22 and 23 by a distance equal to the downward extensions of sidewalls 24 and 25. As a result, the total weight of the user is distributed between sidewalls 24 and 25 together with intermediate supporting walls 40 through 49 to provide significant rigidity and strength for board 11.

Figure 6:
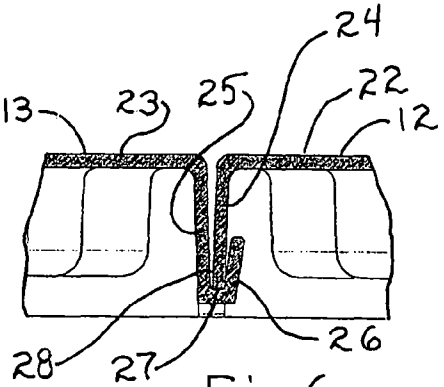
FIG. 6 sets forth an enlarged partial section of the board joint of the present invention pushup exerciser shown in FIGS. 4 and 5.

FIG. 6 sets forth a partial section view of board 11 showing board section junction 14 in enlarged detail. More specifically, board section 12 defines a sidewall 24 and a top surface 22 as described above. As is also described above, board section 13 defines a sidewall 25 and a top surface 23. Board section junction 14 includes a generally U-shaped upwardly open channel wall 26 formed at the lower end of sidewall 25 of board section 13. Board section junction 14 further includes a wall flange 27 formed in sidewall 24 of board section 12. Of importance to note is the formation of an elongated notch 28 formed in wall flange 27. Notch 28 facilitates the insertion of wall flange 27 into channel wall 26 while maintaining the support surface contact of sidewalls 24 and 25. The extension of wall flange 27 into channel wall 26 secures the position of board sections 12 and 13 and forms board section junction 14. This secure attachment resists any separation of board sections 12 and 13 during exercise activities. When the user desires to separate board segments 12 and 13 the user simply forces board section 12 upwardly while forcing board section 13 downwardly which withdraws wall flange 27 from channel wall 26. Once separated, board sections 12 and 13 may be stacked for compact storage and/or transport.

Figure 7:
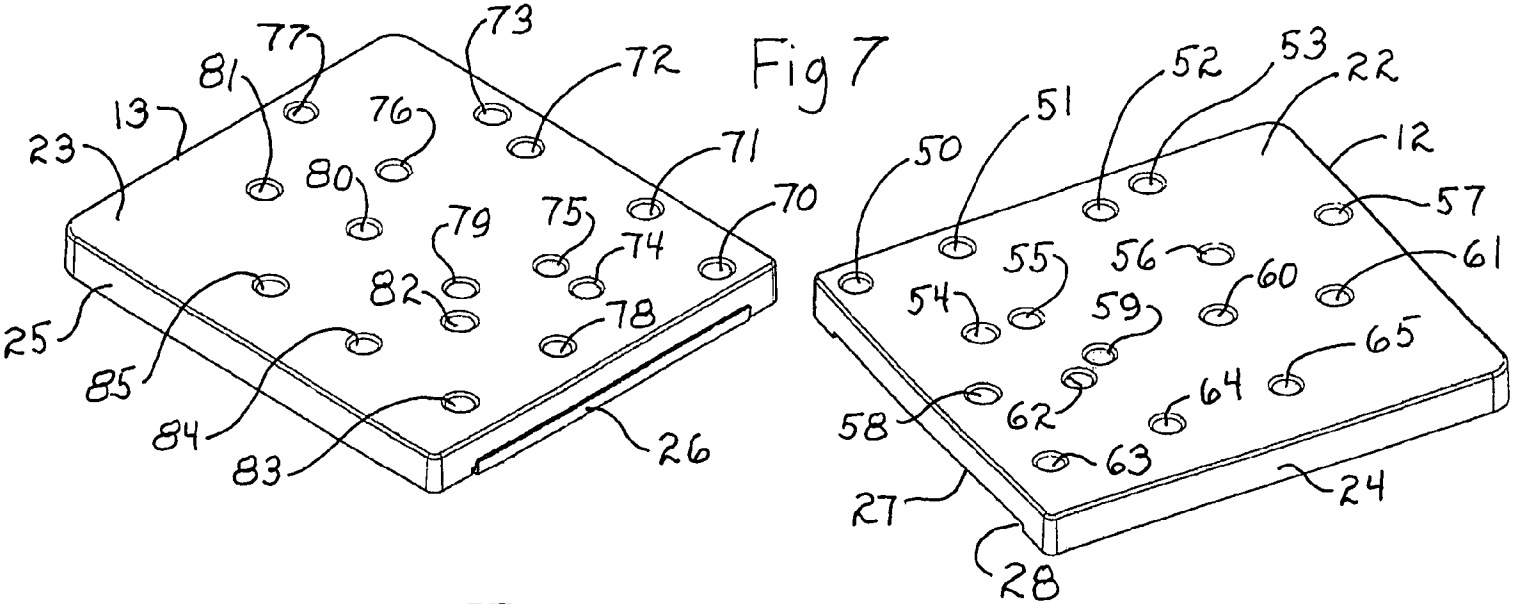
FIG. 7 sets forth a perspective view of the board portion of the present invention pushup exerciser shown in FIG. 4 having segments thereof separated.

FIG. 7 sets forth a perspective assembly view of board sections 12 and 13 in which the board sections are separated from each other. As described above, board section 12 defines a top surface 22 within which a plurality of post receptacles 50 through 65 are formed. As is also described above, board section 12 includes a downwardly extending sidewall 24. Sidewall 24 includes a portion defining a wall flange 27 having a notch 28 formed therein.

Board section 13 also described above includes a top surface 23 having a plurality of post receptacles 70 through 85 formed therein. Board section 13 further includes a downwardly extending sidewall 25 having a channel wall 26 formed along one portion thereof. Channel wall 26 defines an upwardly open generally U-shaped channel which receives wall flange 27 of board section 12 in the manner shown in FIG. 6.

Figure 8:
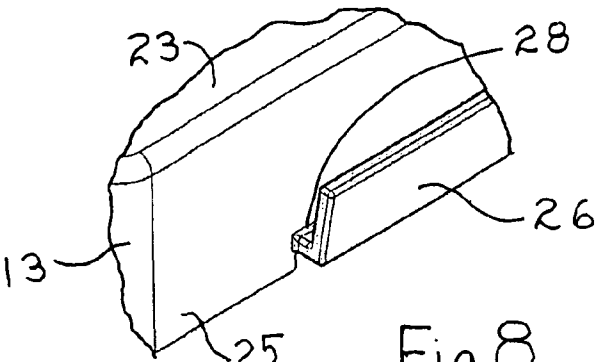
FIG. 8 sets forth a partial perspective view of the joint structure of the board portion of the present invention pushup exerciser shown in FIG. 7.

FIG. 8 sets forth a partial perspective view of board section 13 having sidewall 25 and top surface 23. Of importance to note in FIG. 8 is the structure of upwardly open U-shaped channel wall 26.

Figure 9:
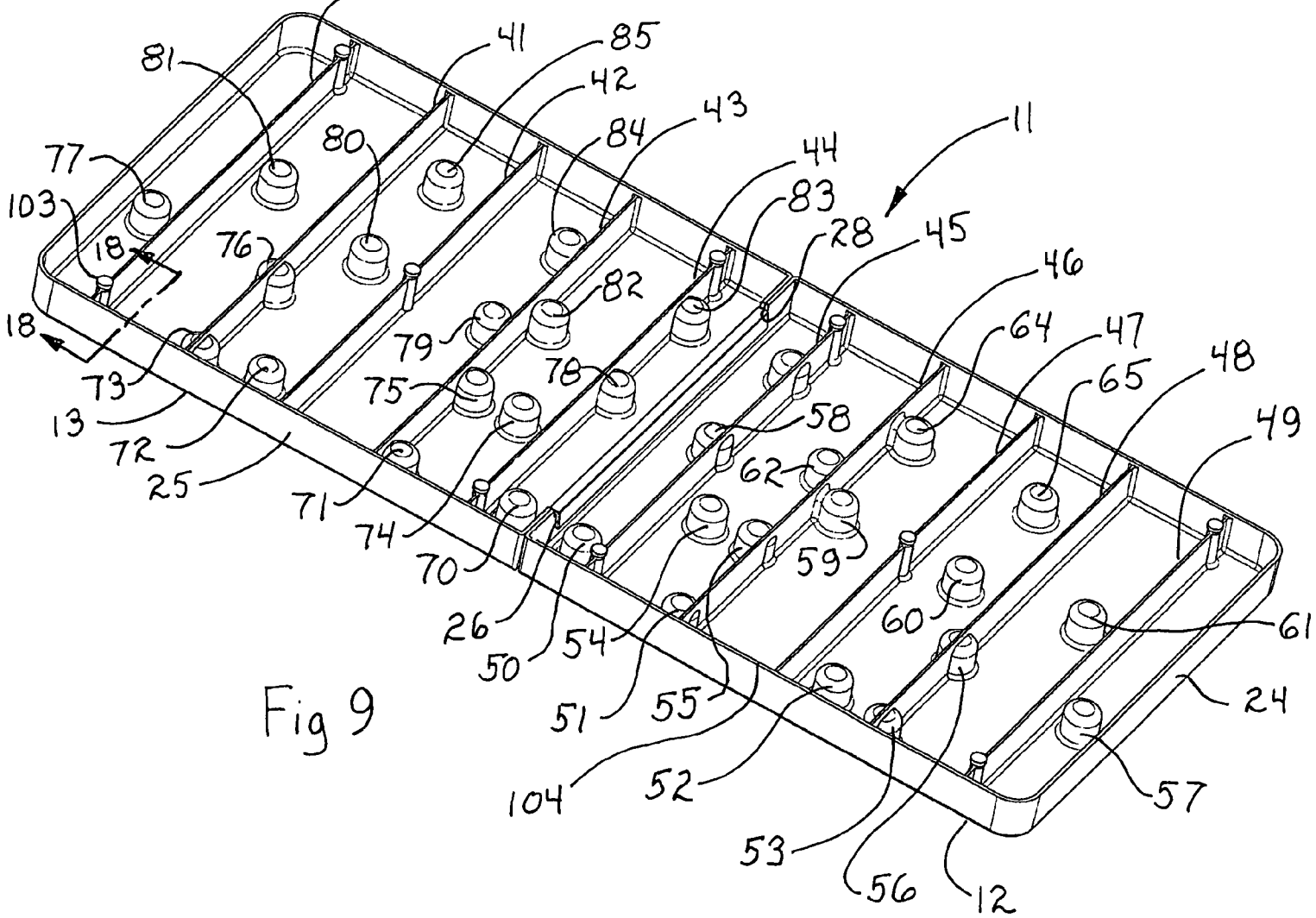
FIG. 9 sets forth a bottom perspective view of the board portion of the present invention exerciser shown in FIG. 4.
Figure 18:
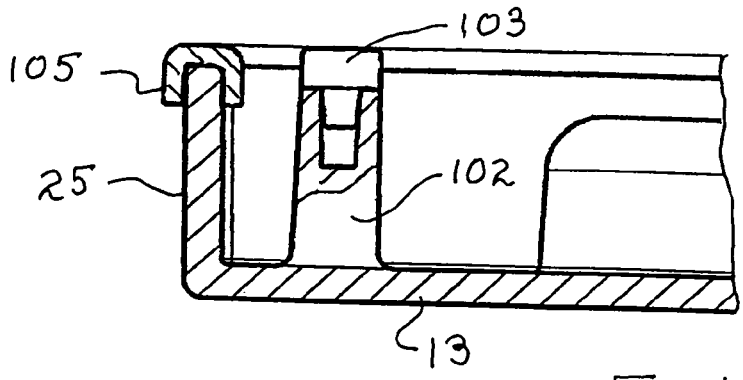
FIG. 18 sets forth a partial section view of board section 13 taken along section lines 18-18 in FIG. 9.

FIG. 9 sets forth a bottom perspective view of board 11. As described above, board 11 is formed of board sections 12 and 13 having respective downwardly extending sidewalls 24 and 25. Board sections 12 and 13 are joined along board section junction 14 by the cooperation of wall flange 27 and channel wall 26 as shown in FIG. 6. For added strength, board section 13 includes a plurality of downwardly extending intermediate support walls 40 through 44 while board section 12 includes a corresponding set of downwardly extending intermediate support walls 45 through 49. Support walls 40 through 49 are recessed with respect to sidewalls 24 and 25. Board sections 12 and 13 also include a plurality of posts 102 extending downwardly from the upper surfaces of board sections 12 and 13. Sidewalls 24 and 25 together with posts 40 cooperate to support the weight upon board 11. Sidewalls 24 and 25 include resilient beads 104 and 105 respectively while posts 102 each further include a resilient foot 103 which are shown in FIG. 18 below. Suffice it to note here that resilient feet 103 together with resilient beads 104 and 105 provide a non-slip floor surface protective support for board 11. As described above, board section 12 includes post receptacles 50 through 65 while board section 13 includes post receptacles 70 through 85.

Figure 10:
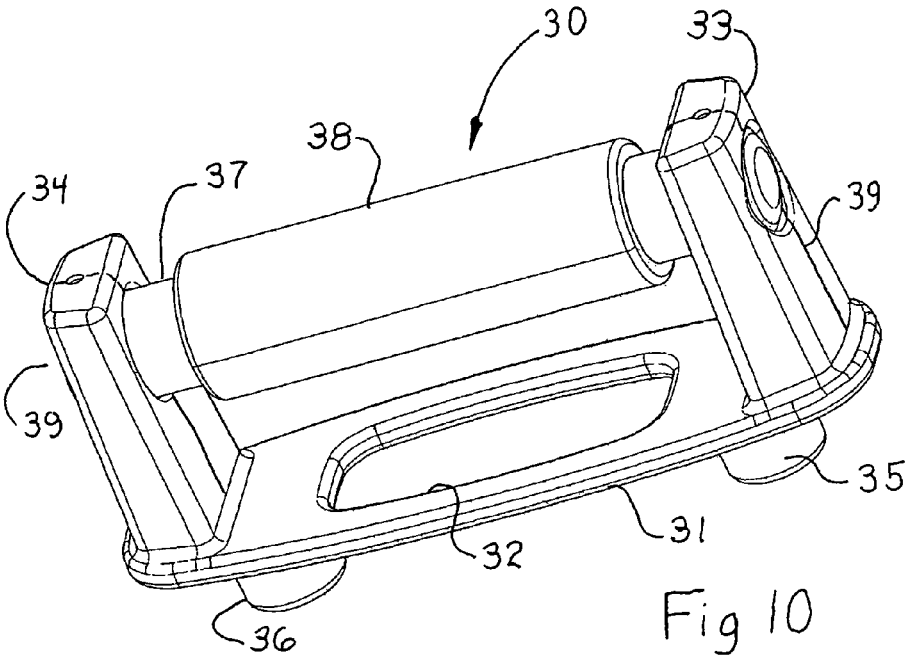
FIG. 10 sets forth a perspective view of an exemplary handle constructed in accordance with the present invention.

FIG. 10 sets forth a perspective view of handle unit 30. Handle unit 30 includes an elongated base 31 defining a generally rectangular aperture 32 therein. Base 31 further supports a pair of downwardly extending generally extending generally cylindrical posts 35 and 36. Handle 30 further includes a pair of upwardly extending grip supports 33 and 34 together with a generally cylindrical grip bar 37. Grip bar 37 extends between grip supports 33 and 34 and is secured in manner set forth below in FIG. 12. Suffice it to note here that generally cylindrical grip bar 37 is secured between grip supports 33 and 34 in a fixed attachment. Handle unit 30 further includes a generally cylindrical handle grip 38 formed upon grip bar 37 and preferably fabricated of a soft resilient elastic material such as foam rubber or foam plastic. Additionally, handle grip 38 may be fabricated of other nonslip materials such as leather or the like. While handle unit 30 may be fabricated in any suitable manner, in the anticipated fabrication of handle unit 30, a pair of molded plastic half portions will be joined along a center line 39 extending through grip supports 33 and 34, base 31 and posts 35 and 36. As is better seen in FIG. 12, these molded plastic half portions will be joined using attachment such as a conventional adhesive together with one or more fasteners as indicated by fasteners 66 through 69 (seen in FIG. 12).

Figure 11:
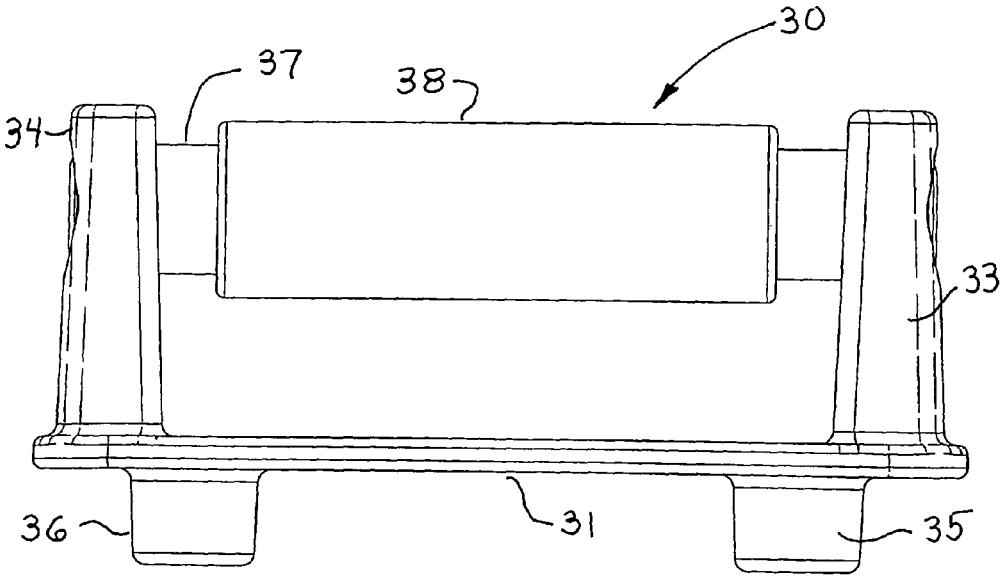
FIG. 11 sets forth a side elevation view of the handle shown in FIG. 10.

FIG. 11 sets forth a side elevation view of handle unit 30 which, as described above, includes a base 31 supporting a pair of generally cylindrical posts 35 and 36. Handle unit 30 further includes a pair of upwardly extending grip supports 33 and 34 together with a generally cylindrical grip bar 37. Grip bar 37 extends between and is secured by grip supports 33 and 34. Finally, handle unit 30 includes a resilient handle grip 38 supported upon grip bar 37.

Figure 12:
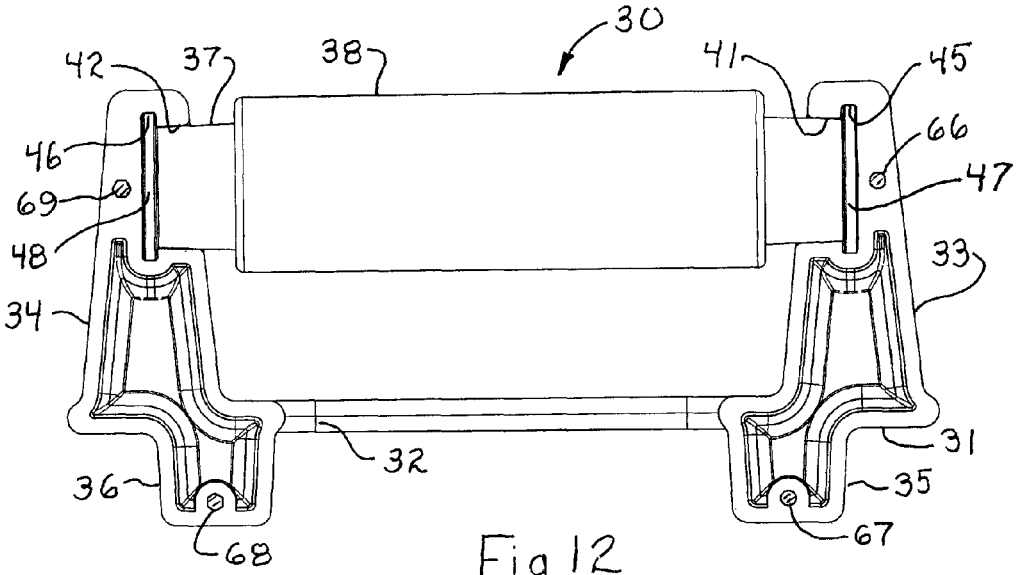
FIG. 12 sets forth a section view of the handle shown in FIG. 11.

FIG. 12 sets forth a section view of handle unit 30 taken along parting line 39 shown in FIG. 10. As described above, handle unit 30 includes a pair of mirror image molded plastic half portions which are joined by a plurality of fasteners 66 through 69. Thus, handle unit 30 includes a base 31 defining an aperture 32 therein. Base 31 further supports downwardly extending generally cylindrical posts 35 and 36. Base 31 further supports a pair of upwardly extending grip supports 33 and 34. Grip supports 33 and 34 define respective cylindrical bores 41 and 42. Grip supports 33 and 34 further define radially extending grooves 45 and 46 at the interior ends of bores 41 and 42. Handle unit 30 further includes a generally cylindrical grip bar 37 extending through bores 41 and 42. Handle grip 37 further defines a pair of radially extending flanges 47 and 48 which are received within grooves 45 and 46 respectively. Handle unit 30 further includes a resilient handle grip 38 which, as mentioned above, is preferably formed of a resilient material such as foam rubber or foam plastic or other suitable easily gripped material.

As mentioned above, handle units 30 and 40 are identical in fabrication. Accordingly, the descriptions and figures set forth above which illustrate and describe the structure of handle unit 30 will be understood to apply equally well and be equally descriptive of handle unit 40.

Figure 13:
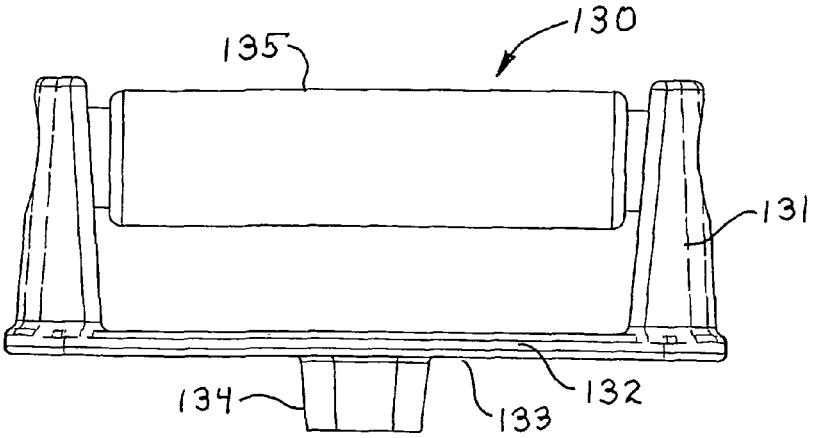
FIG. 13 sets forth a side elevation view of an alternate embodiment handle utilized in the present invention pushup exerciser.
Figure 14:
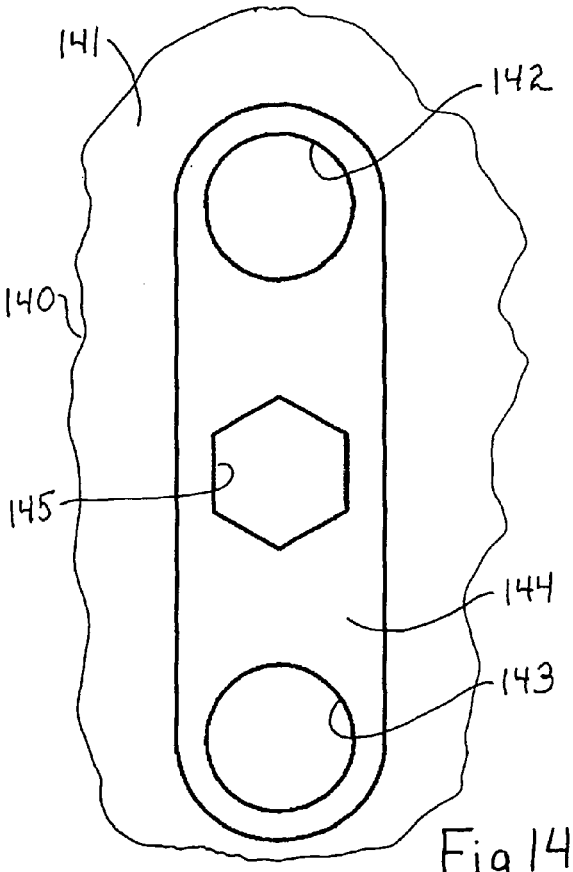
FIG. 14 sets forth a portion of the exerciser board utilized in combination with the alternate embodiment handle shown in FIG. 13.
Figure 15:
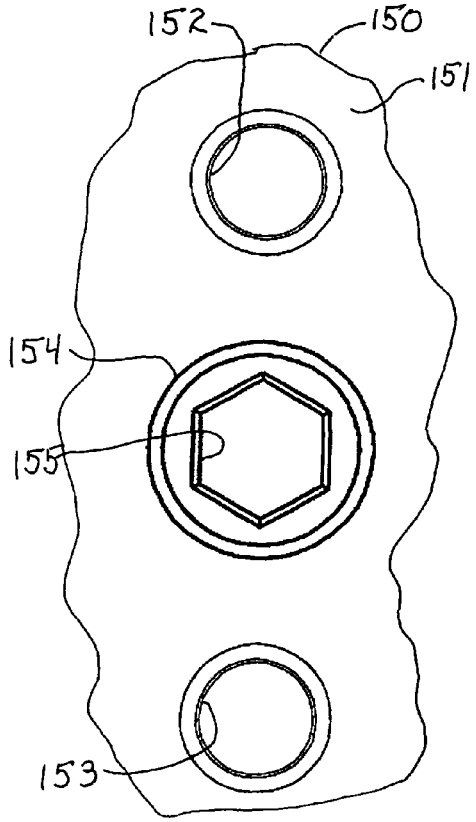
FIG. 15 sets forth a portion of the cooperating board alternately used in combination with the handle shown in FIG. 13.

FIGS. 13 through 15 set forth an alternate embodiment of the present invention in which handle units 30 and 40 are replaced or supplemented by a handle unit constructed to utilize an alternative apparatus for securing, locating and angularly fixing the position of the handles upon the board portions of the present invention pushup exerciser. In essence, the embodiment set forth in FIGS. 13 through 15 replaces the pair of downwardly extending posts formed in handle units 30 and 40 (seen in FIGS. 10 through 12) with a single fasted posts.

More specifically, FIG. 13 sets forth a side elevation view of a handle unit constructed in accordance with an alternate embodiment of the present invention and generally referenced by numeral 130. Handle unit 130 includes a generally rectangular frame 131 having a base portion 132 which in turn provides a bottom surface 133. Base 132 supports a downwardly extending faceted post 134. Post 134 is faceted with to cooperate with a faceted post receptacle (receptacle 145 shown in FIG. 14 receptacle 155 shown in FIG. 15). The faceting of post 134 and cooperating faceted receptacles 145 and 155 provide the angular fixing of the position of handle 130 utilized in the present invention pushup exerciser. Handle unit 130 further includes a resilient grip 135 formed upon the upper portion of frame 131. Grip 135 is preferably formed of a suitable resilient soft material such as foam rubber or foam plastic. Alternatively, grip 135 may be fabricated of a suitable leather or other material.

FIG. 14 sets forth a partial top view of a board section 140 which is fabricated in general accordance with board sections 12 and 13 set forth above. Thus, board section 140 includes a top surface 141 supporting pairs of generally cylindrical post receptacles such as receptacles 142 and 143. In further similarity to the above-described embodiment, a color indicia 144 extends between post receptacles 142 and 143. Board section 140 differs from board sections 12 and 13 set forth and described above in that it further utilizes a faceted post receptacle 145. Post receptacle 145 is formed to receive faceted post 134 of handle unit 130 (seen in FIG. 13). In the example set forth in FIGS. 13 and 14, faceted post 134 is hexagonal in cross section. Correspondingly, faceted receptacle 145 is also hexagonal in cross section. However, it will be apparent to those skilled in the art that a different faceted structure may be utilized such as triangular or octagonal or square without departing from the embodiment of the invention shown in FIGS. 13 through 15.

In operations, handle unit 130 may be positioned upon board section 140 by inserting faceted post 134 into faceted receptacle 145. It will be apparent that the faceted structure of post 134 and receptacle 145 provide for a plurality of angularly fixed positions for handle unit 130 upon board section 140. Thus, the very desirable angular fixing of handle unit 130 during the pushup exercise is maintained.

FIG. 15 sets forth a portion of a board section constructed in accordance with the alternative embodiment of the present invention set forth in FIGS. 13 and 14 above. This further alternate embodiment includes a board section 150 constructed in a similar fashion to board sections 12 and 13 set forth above. Thus, board section 150 includes a top surface 151 within which a pair of post receptacles 152 and 153 are formed. Board section 150 further includes a faceted receptacle 155 surrounded by a color indicia 154. Color indicia 154 performs the same function as the embodiment set forth above in FIGS. 1 through 3 in that color indicia are utilized to indicate the particular muscle groups to be emphasized.

Figure 16:
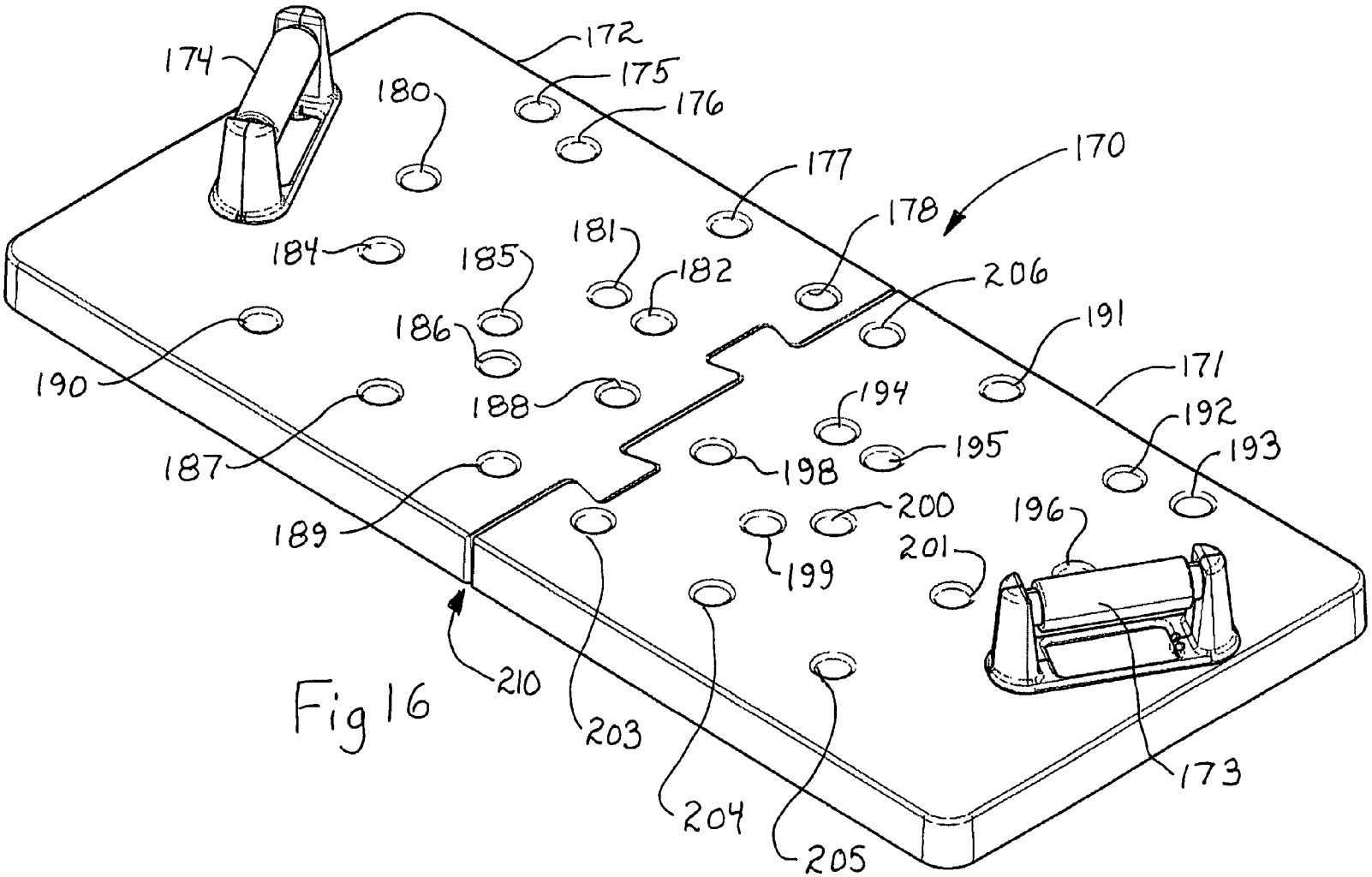
FIG. 16 sets forth a perspective view of a further alternate embodiment of the present invention pushup exerciser.

FIG. 16 sets forth a perspective view of a further alternate embodiment of the present invention pushup exerciser generally referenced by numeral 170. Pushup exerciser 170 is similar to exerciser 10 set forth and described above in that it includes a board comprised of a pair of board sections each defining a plurality of post receptacle pairs for receiving and fixing a pair of handle units on the board surface at selectable positions. Pushup exerciser 170 differs in that board section junction 210 is not straight-line as above, but rather defines a pair of oppositely directed "dove-tail" joints to join the board sections. In all other respects, pushup exerciser 170 is fabricated and operative in the manner described above.

Thus, pushup exerciser 170 includes board sections 171 and 172 joined at a board section junction 210. Board section 171 defines a plurality of post receptacles 191 through 206. while board section 172 defines a plurality of post receptacles 175 through 190. Post receptacles 191 through 206 and 175 through 190 are arranged in pairs to receive handle units 173 and 174. Board sections 171 and 172 also support color indicia in the manner shown above in FIG. 1 which are omitted from the figure to avoid cluttering FIG. 16.

Figure 17:
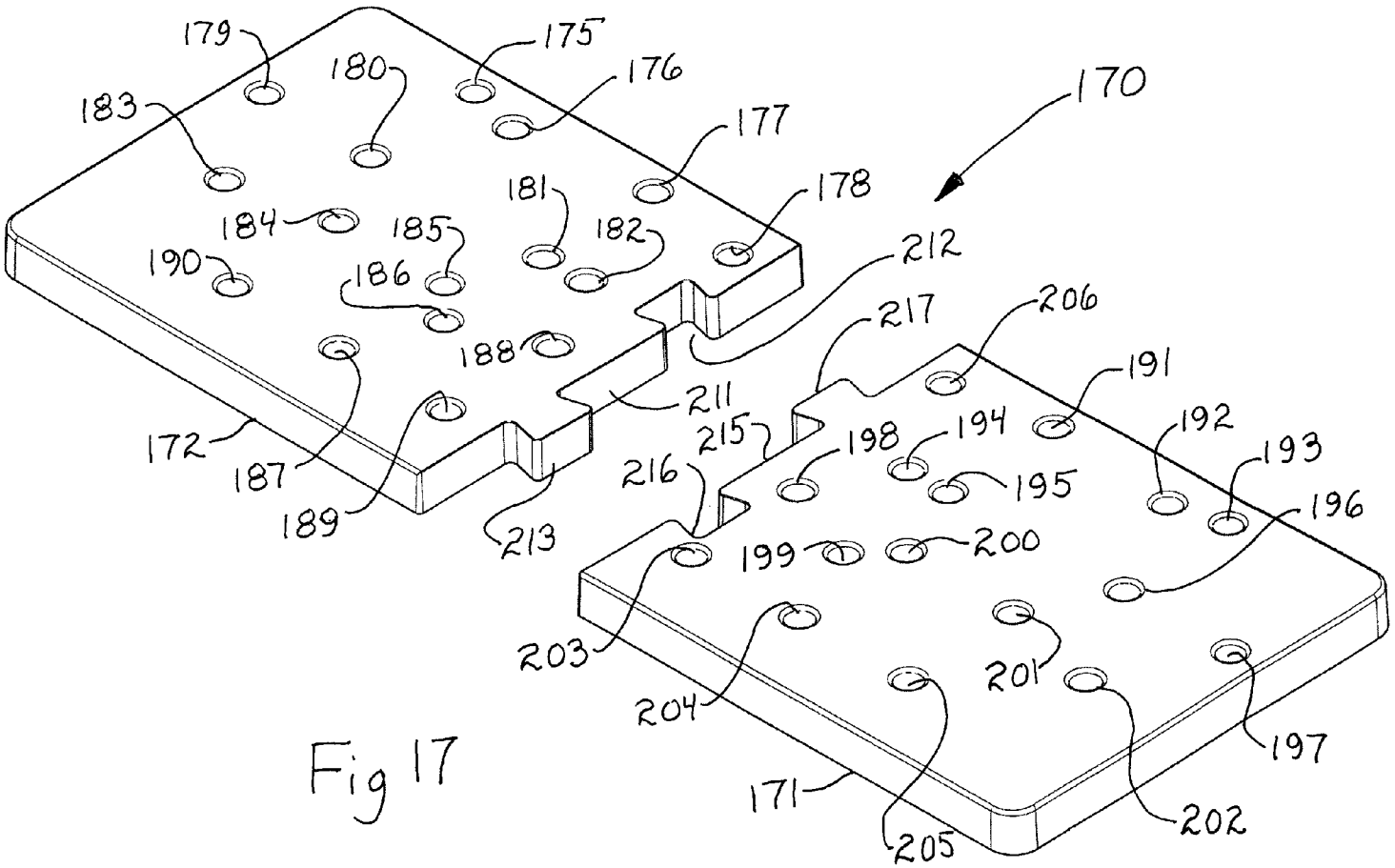
FIG. 17 sets forth a perspective assembly view of the board portion of the alternate embodiment of FIG. 16.

FIG. 17 sets forth an assembly view of board sections 171 and 172. As mentioned above, pushup exerciser 170 includes board sections 171 and 172 joined at a board section junction 210. Board section 171 defines a plurality of post receptacles 191 through 206. while board section 172 defines a plurality of post receptacles 175 through 190. Post receptacles 191 through 206 and 175 through 190 are arranged in pairs to receive handle units 173 and 174. As is also mentioned above, board sections 171 and 172 also support color indicia in the manner shown above in FIG. 1 which are omitted from the figure to avoid cluttering FIG. 17.

Board section 171 defines a junction wall 211 having a dove-tail notch 212 and a dove-tail extension 213 formed therein. Correspondingly, board section 172 defines a junction wall 215 having a dove-tail notch 216 and a dove-tail extension 217 formed therein. Board sections 171 and 172 are joined by inserting dove-tail extensions 213 and 217 into dove-tail notches 216 and 212 respectively. This provides a secure attachment between board sections 171 and 172 during use which may be separated for storage and transport as needed.

FIG. 18 sets forth a partial section view of board section 13 taken along section lines 18-18 in FIG. 9. As described above, board section 13 includes a recessed support wall 40 and a sidewall 25. As is also described above, board section 13 includes a plurality of supporting posts 102, each of which includes a resilient foot 103. Sidewall 25 supports a resilient bead 105. As is better seen in FIG. 9, board section 12 also include a plurality of support posts 102 having resilient feet 103 and a resilient sidewall bead 104. It will be understood that the structure of board section 12 is identical to that of board section 13. Thus, board sections 12 and 13 are supported upon resilient beads 104 and 105 together with resilient feet 103. This provides a non-slip footing for board 11 (seen in FIG. 1) and protects the underlying surface (ie floor) as weight is borne by board 11.

Figure 19:
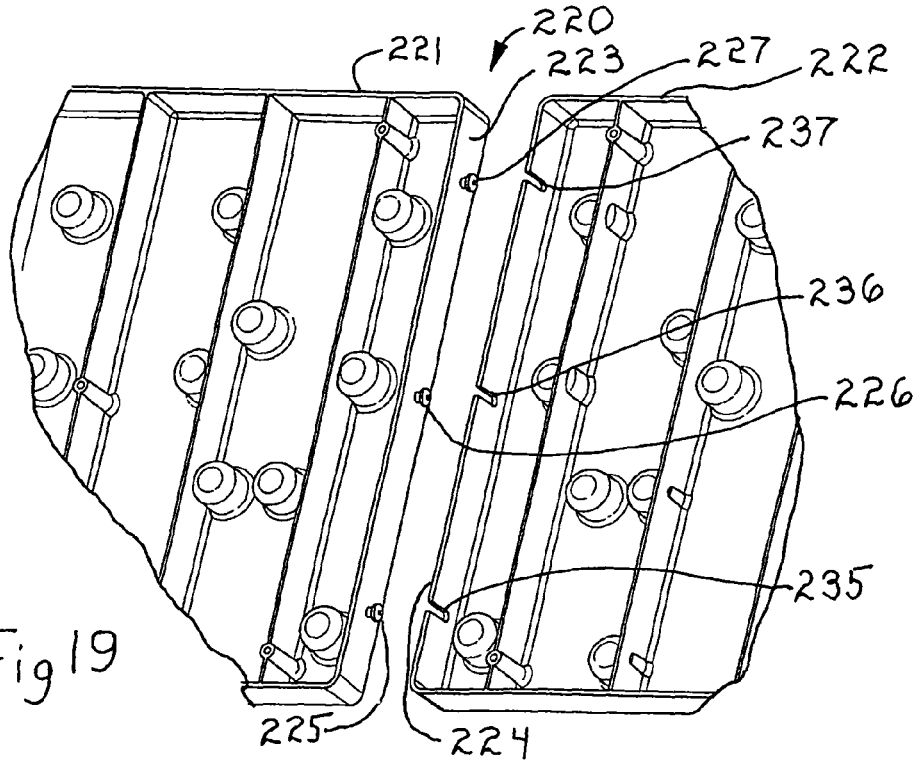
FIG. 19 sets forth a partial bottom assembly view of a still further embodiment of the present invention pushup exerciser.

FIG. 19 sets forth a partial underside perspective view of a still further alternate embodiment of the present invention pushup exerciser generally referenced by numeral 220. Board sections 221 and 222 are, apart from the section joining mechanism shown, substantially identical to board sections 12 and 13 show above in FIG. 1. Board sections 221 and 222 are joined by a peg and slot arrangement. Accordingly, board section 221 includes a sidewall 223 supporting a trio of headed pegs 225, 226 and 227. Correspondingly, board section 222 includes a sidewall 224 supporting a trio of slots 235, 236 and 237 which receive pegs 225, 226 and 227 respectively as shown in FIG. 20 below.

Figure 20:
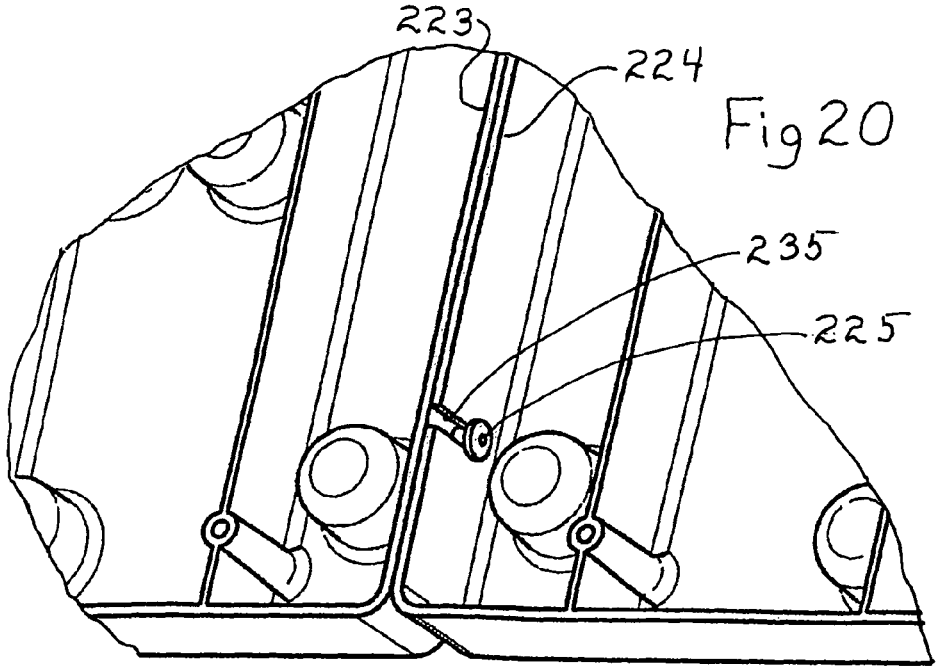
FIG. 20 sets forth an enlarged perspective view of the board section coupling of the embodiment of FIG. 19.

FIG. 20 sets forth a partial perspective view of the coupling mechanism that joins board sections 221 and 222 (seen in FIG. 19). Accordingly, sidewalls 223 and 224 are secured together by the insertion of headed peg 225 into slot 235. It will be understood that pegs 226 and 227 are similarly received within slots 236 and 237 (seen in FIG. 19).

Figure 21:
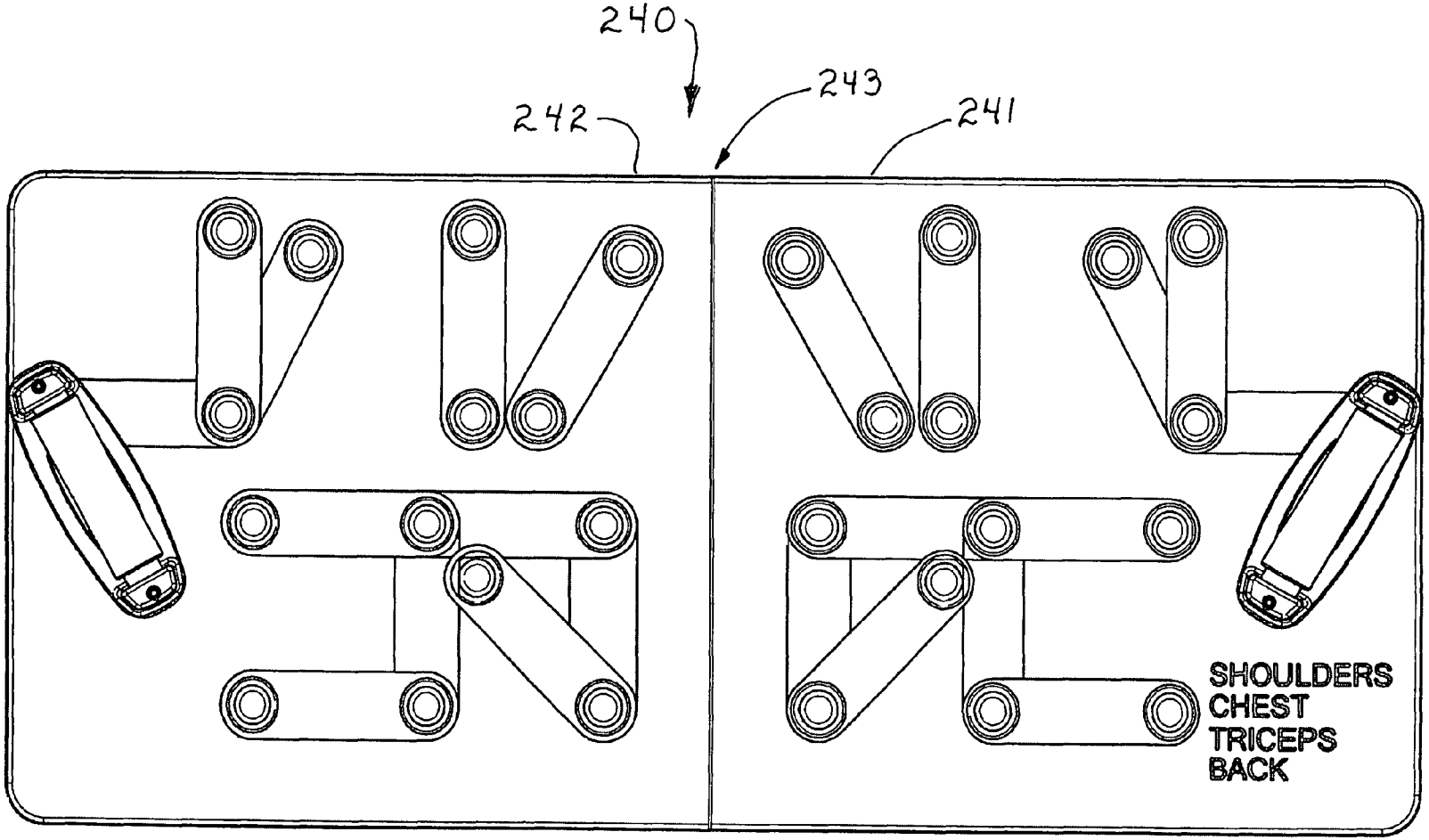
FIG. 21 sets forth a top view of a still further alternate embodiment of the present invention pushup exerciser.

FIG. 21 sets forth a top view of a still further alternate embodiment of the present invention pushup exerciser generally referenced by numeral 240. Exerciser 240 includes board sections 241 and 242 joined at a junction 243. Board sections 241 and 242 are, apart from the section attachment mechanism shown below in FIGS. 22, 23 and 24, substantially identical to board sections 12 and 13 shown above in FIG. 1.

Figure 22:
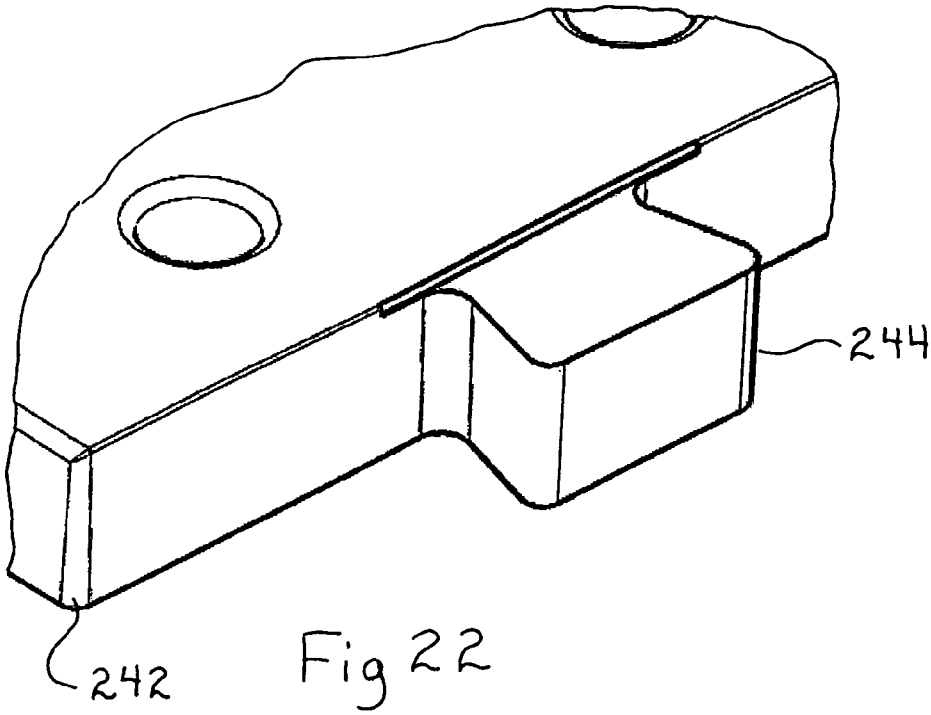
FIG. 22 sets forth a partial perspective view of a dovetail coupler used in the embodiment of FIG. 21.

FIG. 22 sets forth a perspective view of board section 242 showing a dove tail coupler 244.

Figure 23:
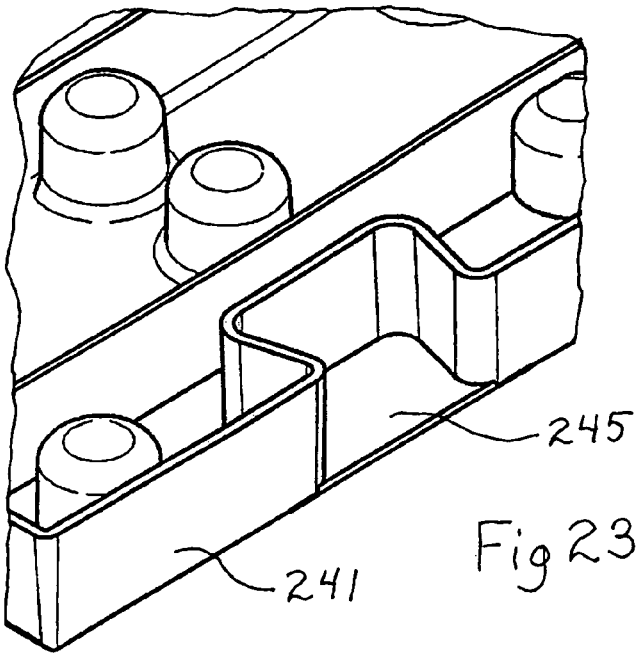
FIG. 23 sets forth a partial perspective view of a dovetail coupler socket used in the embodiment of FIG. 21.

FIG. 23 sets forth a perspective view of board section 241 showing a dovetail socket 245.

Figure 24:
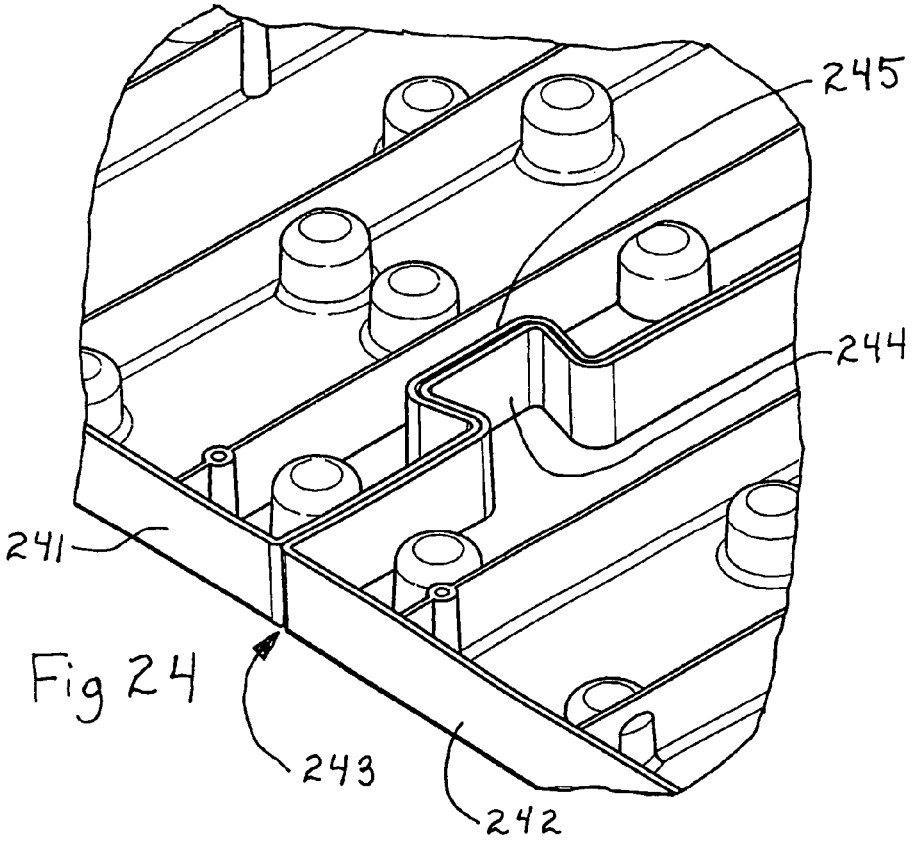
FIG. 24 sets forth a partial perspective view of the dovetail coupler and socket assembled.

FIG. 24 sets forth a perspective view of dovetail coupler 244 received within dovetail socket 245. The dovetail coupling thus formed joins board sections 241 and 242 along junction 243. It will be understood that a plurality of dovetail couplers similar to that shown in FIG. 24 are used to join board sections 241 and 242.

What has been shown is a novel pushup exerciser having multiple hand positioning handle units which are selectively attachable to a supporting board for exercise of different muscle groups during pushup exercise. The invention shown includes a supporting board formed of a pair of board sections joined along a board section junction to form a rigid board structure. The board sections may be separated to facilitate compact and convenient storage and transport. The pushup exerciser includes a plurality of post receptacles disposed upon the supporting board in paired arrangement each paired arrangement defining a position, location and angle orientation of a handle unit received within. Coordinating color indicia are provided in association with each post receptacle pair to provide easy identification of muscle group emphasis for each receptacle pair and handle unit location.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. Apparatus for performing pushup exercises, said apparatus comprising:

a generally planar board defining a generally planar top surface;

a plurality of post receptacles formed in said top surface;

a pair of handle units each handle unit having a base, defining a viewing aperture in said base, and attachment means for engaging selected ones of said post receptacles to position said handle unit upon said top surface in a selected location and angular orientation upon said top surface; and a plurality of color indicia formed on said top surface in association with selected ones of said post receptacles defining selected handle unit positions, said color indicia defining groups of color indicia, each group being distinguishable from other groups by a characteristic color, whereby said post receptacles and said color indicia groups cooperate to define selected handle unit positions of said handle units upon said board, said color indicia being observable through said viewing aperture of each of said handle units when said handle unit is placed at one of said selected handle unit positions.

2. The apparatus set forth in claim 1 wherein said groups of color indicia include a first group of color indicia defining a first color and a second group of color indicia defining a second color, said first color being different from said second color.

3. The apparatus set forth in claim 2 wherein said first color is common to handle unit locations and angular orientations for emphasizing a first muscle group and wherein said second color is common to handle unit locations and angular orientations for emphasizing a second muscle group.

4. Apparatus for performing pushup exercises, said apparatus comprising:

a generally planar board defining a generally planar top surface, said board including a first board section defining a first top surface having a first plurality of post receptacles formed therein and defining a first junction edge, and a second board section defining a second top surface having a second plurality of post receptacles formed therein and defining a second junction edge, said first and second junction edges cooperating to join said first and second board sections in a removable attachment board section junction, first and second pluralities of post receptacles are arranged in substantially mirror image patterns with respect to said board section junction and are formed in said top surface arranged in receptacle pairs to define handle positions and each receptacle in each pair being separated from its pair member by a predetermined receptacle spacing;

a pair of handle units each having a pair of posts spaced-apart by a distance equal to said predetermined receptacle spacing for engaging selected ones of said post receptacles pairs in a fixed location and angular orientation upon said top surface; and a plurality of color indicia formed on said top surface each connecting a pair of said post receptacles in a receptacle pair, said color indicia defining groups of color indicia each group being distinguishable from other groups by a characteristic color whereby said post receptacles and said color indicia groups cooperate to define selected positions of said handle units upon said board, said handle units in said pair of handle units each include a base supporting a handle grip and defining a viewing aperture in said base through which a color indicia beneath said base is observable.

5. The apparatus set forth in claim 4 wherein said handle units each include a pair of grip supports extending upwardly from said base and a grip bar supporting said handle grip and extending between said grip supports.

6. Apparatus for performing pushup exercises, said apparatus comprising:

a generally planar board defining a generally planar top surface;

a plurality of post receptacles formed in said top surface arranged in receptacle pairs to define handle positions and each receptacle in each pair being separated from its pair member by a predetermined receptacle spacing;

a pair of handle units each having a pair of posts spaced-apart by a distance equal to said predetermined receptacle spacing for engaging selected ones of said post receptacles pairs in a fixed location and angular orientation upon said top surface; and a plurality of color indicia formed on said top surface each connecting a pair of said post receptacles in a receptacle pair, said color indicia defining groups of color indicia each group being distinguishable from other groups by a characteristic color whereby said post receptacles and said color indicia groups cooperate to define selected positions of said handle units upon said board, said handle units in said pair of handle units each including a base supporting a handle grip and defining a viewing aperture in said base through which a color indicia beneath said base is observable.

7. The apparatus set forth in claim 6 wherein said groups of color indicia include a first group of color indicia defining a first color and a second group of color indicia defining a second color, said first color being different from said second color.

8. The apparatus set forth in claim 7 wherein said first color is common to handle unit locations and angular orientations for emphasizing a first muscle group and wherein said second color is common to handle unit locations and angular orientations for emphasizing a second muscle group.

* * * * *